US007136039B2

(12) United States Patent
Bu et al.

(10) Patent No.: US 7,136,039 B2
(45) Date of Patent: Nov. 14, 2006

(54) METHOD AND RELATED APPARATUS FOR DRIVING AN LCD MONITOR

(75) Inventors: Lin-Kai Bu, Tainan County (TW); Chin-Feng Cheng, Tainan County (TW); Tsung-Yu Wu, Tainan County (TW); Chuan-Cheng Hsiao, Tainan County (TW)

(73) Assignee: Himax Technologies, Inc., Hsinhua (TW)

( * ) Notice: Subject to any disclaimer, the term of this patent is extended or adjusted under 35 U.S.C. 154(b) by 231 days.

(21) Appl. No.: 10/065,665

(22) Filed: Nov. 7, 2002

(65) Prior Publication Data

US 2003/0234758 A1 Dec. 25, 2003

Related U.S. Application Data

(63) Continuation-in-part of application No. 10/064,207, filed on Jun. 21, 2002.

(51) Int. Cl.
*G09G 3/36* (2006.01)

(52) U.S. Cl. ..... 345/98; 345/87; 345/89; 345/90; 345/94; 345/100; 345/204; 345/212; 345/214

(58) Field of Classification Search ..... 345/211–213, 345/87, 98, 100, 204, 94, 89, 90, 214
See application file for complete search history.

(56) References Cited

U.S. PATENT DOCUMENTS 5,056,012 A * 10/1991 Spiotta et al. ..... 709/251
6,331,847 B1 * 12/2001 Kim et al. ..... 345/100
6,466,192 B1 * 10/2002 Imamura ..... 345/98
6,747,624 B1 * 6/2004 Udo et al. ..... 345/89
6,756,959 B1 * 6/2004 Fujino ..... 345/95
6,756,962 B1 * 6/2004 Akimoto et al. ..... 345/98
2002/0050972 A1 * 5/2002 Udo et al. ..... 345/96
2004/0196550 A1 * 10/2004 Shimizu ..... 345/3.1

FOREIGN PATENT DOCUMENTS

| | | | |
|---|---|---|---|
| JP | H05-035211 | A | 2/1993 |
| JP | H10-111671 | A | 4/1998 |
| JP | H10-207415 | A | 8/1998 |
| JP | H10-333643 | A | 12/1998 |
| JP | H11-205149 | A | 7/1999 |
| KR | 1998-087415 | | 12/1998 |
| KR | 2000-0008960 | | 2/2000 |

* cited by examiner

*Primary Examiner*—Richard Hjerpe
*Assistant Examiner*—Jennifer T. Nguyen
(74) *Attorney, Agent, or Firm*—Winston Hsu

(57) ABSTRACT

A method for driving an LCD monitor is disclosed. The LCD monitor includes a voltage selection unit used for outputting a plurality of driving voltages according to display data, and a plurality of output buffers each electrically connected to the voltage selection circuit and a corresponding pixel. In the beginning, an output port of each output buffer approaches voltage at an input port. Then, the output ports of the driving units, which approach the same input voltage, are electrically connected to have an average voltage. In addition, the LCD monitor further includes a timing controller for controlling operation of the output buffers. When output ports of the output buffers, which approach the same input voltage, are electrically connected, the output buffers are turned off for saving power.

36 Claims, 8 Drawing Sheets

METHOD AND RELATED APPARATUS FOR DRIVING AN LCD MONITOR

BACKGROUND OF INVENTION

1. Field of the Invention

The present invention relates to a method and a related apparatus for driving an LCD monitor, and more particularly, to a method and a related apparatus which can drive pixels located in a row of the LCD panel toward a target level so as to display a uniform gray level.

2. Description of the Prior Art

The advantages of the liquid crystal display (LCD) include lighter weight, less electrical consumption, and less radiation contamination. Thus, the LCD has been widely applied to several portable information products such as notebooks, and PDAs. The LCD gradually replaces the cathode ray tube (CRT) monitors of the conventional desktop computers. The incident light will produce different polarization or refraction effects when alignment of these liquid crystal molecules is different. The LCD utilizes the characteristics of the liquid crystal molecules to generate red, blue, and green lights with different intensities of gray level to produce gorgeous images.

Please refer to FIG. 1 of a schematic diagram of a conventional thin film transistor (TFT) liquid crystal display (LCD) 10. The LCD 10 comprises an LCD panel 12, a control circuit 14, a first driving circuit 16, a second driving circuit 18, a first power supply 20, and a second power supply 22. The LCD panel 12 is composed of two substrates and an LCD layer interposed between the two substrates. A plurality of data lines 24, a plurality of gate lines 26, which are perpendicular to the data lines 24, and a plurality of thin film transistors 28 are disposed on one of the two substrates. A common electrode is disposed on the other substrate for providing a constant voltage Vcom via the first power supply 20. For easier description, only one thin film transistor 28 is illustrated in FIG. 1. However, a plurality of thin film transistors 28 are respectively disposed on intersections of the data lines 24 and the gate lines 26 in fact. Thus, the thin film transistors 28 are arranged on the LCD panel 12 in a matrix format. In another words, each of the data lines 24 corresponds to one column of the TFT LCD 10, each of the gate lines 26 corresponds to one row of the TFT LCD 10, and each of the thin film transistors 28 corresponds to one pixel. In addition, the two substrates of the LCD panel 12 can be regarded as an equivalent capacitor 30 according to their electrical performance.

The driving method of the conventional TFT LCD 10 is described as follows. The control circuit 14 is used to control driving process of the TFT LCD 10. When the control circuit 14 receives horizontal synchronization 32 and vertical synchronization 34, the control circuit 14 inputs corresponding control signals to the first driving circuit 16 and the second driving circuit 18 respectively. Then, the first driving circuit 16 and the second driving circuit 18 generate input signals for each data line 24, for instance DL3, and each gate line 26, for instance GL3, according to the control signals so as to control conductance of the thin film transistors 28 and voltage differences between two ends of the equivalent capacitors 30 and to rearrange the alignment of the liquid crystal molecules and the corresponding light transmittance in advance. For example, the second driving circuit 18 inputs a pulse to the gate lines 26 so as to make the thin film transistors 28 conduct. Thus, the signals from the first driving circuit 16 to the data lines 24 can be input to the equivalent capacitors 30 via the thin film transistors 28 so as to control the gray levels of the corresponding pixels. In addition, different signals input to the data lines 24 from the first driving circuit 16 are generated based on the voltages $V_0$~V"m transmitted by the second power supply 22. The first driving circuit 16 has a voltage divider 17 for generating a plurality of voltages $V_0$, . . . , Vn based on the voltages $V_0$, . . . , V"m. For example, the second power supply 22 is capable of outputting 10 different voltages $V_0$, . . . , $V''_9$. Therefore, the voltage divider 17 is capable of dividing each of the 10 different voltages $V_0$, . . . , $V_9$ to generate 256 different voltages $V_0$~$V_{255}$. Then, the first driving circuit 16 drives the thin film transistors 28 by selecting one adequate voltage out of the voltage $V_0$, . . . , $V_{255}$ according to the display data 36. Generally speaking, different voltages correspond to different gray levels. A display related to the display data 36 will be shown on the LCD panel 12 in the end.

Please refer to FIG. 1 and FIG. 2. FIG. 2 is a schematic diagram of the first driving circuit 16 shown in FIG. 1 . The first driving circuit 16 further comprises a voltage selection module 56 and an operational amplifier circuit 37 for driving the corresponding thin film transistors 28 respectively according to the different voltages $V_0$ to Vn generated by the voltage divider 17. The operational amplifier circuit 37 comprises a plurality of operational amplifiers 44, 45, 46, 47, 48 and 49. Each of the operational amplifiers 44, 45, 46, 47, 48 and 49 is used to form an output buffer that has a unity gain. In addition, each operational amplifier 44, 45, 46, 47, 48, 49 in the operational amplifier circuit 37 is electrically connected to a corresponding multiplexer (MUX3 to MUX8 shown in FIG. 2) positioned within the voltage selection module 56. It is noteworthy that only six operational amplifiers and related multiplexers are shown in FIG. 2 for simplicity. According to the control signals D3 to D8 outputted from the control circuit 14, the corresponding multiplexers will select one specific voltage level from the different voltages ($V_0$ to $V_n$) generated by the voltage divider 16. Each of the multiplexer (MUX3 to MUX8 for example) functions as an analog-to-digital decoder (DAC) to decode the corresponding display data 36. After decoding the display data 36, the multiplexer is capable of selecting one of the voltages $V_0$, . . . , Vn. In other words, the first driving circuit 16 is used for selecting one of the voltages $V_0$, . . . , Vn and outputting the selected voltage to a corresponding pixel according to the display data 36. It is noteworthy that each voltage level $V_0$, . . . , Vn is individually transmitted via a power transmission line such as a metal wire 66 shown in FIG. 2. When the control circuit 14 receives the horizontal synchronization 32 and the vertical synchronization 34, corresponding signals are then generated and are inputted to the first driving circuit 16, and the second driving circuit 18. For example, when the second driving circuit 18 generates a pulse to make all thin film transistors located in one row conducted, that means thin film transistors 38, 39, 40, 41, 42 and 43 are conducted. The first driving circuit 16 determines that DL3, DL4, DL5, DL6, DL7, and DL8 in the data lines 24 should be driven under the voltage $V_1$ according to the display data 36 so as to drive the thin film transistor 38, 39, 40, 41, 42 and 43 toward the target voltage $V_1$ via the operational amplifier circuit 37. Therefore, the multiplexers MUX3, MUX4, MUX5, MUX6, MUX7, and MUX8 related to the operational amplifiers 44, 45, 46, 47, 48, and 49 are controlled to select the required voltage level such as $V_1$. The operational amplifiers 44, 45, 46, 47, 48, and 49 take the voltage level, for instance $V_1$, as an input voltage to drive the thin film transistor 38, 39, 40, 41, 42, and 43 later. However, the operational amplifiers 44, 45, 46, 47, 48 and 49 have different offsets affecting the actual output voltages so that the voltage differences of the capacitors 50, 51, 52, 53, 54, and 55 are different. According to the display data 36, the pixels corresponding to DL3, DL4, DL5, DL6, DL7, and DL8 in the data lines 25 should display the same gray level. However, the gray levels in the display screen are not uniform because different offsets of the output voltages are made by the operational amplifiers 44, 45, 46, 47, 48 and 49, which therefore deteriorates the display quality.

SUMMARY OF INVENTION

It is therefore a primary objective of the claimed invention to provide a method for driving an LCD monitor which can make pixels located in the same row of the LCD panel have the same target level so as to display a uniform gray level.

In a first preferred embodiment, the claimed invention provides a method of driving a liquid crystal display (LCD) monitor. The LCD monitor comprises an LCD panel for displaying a plurality of pixels arranged in a matrix format, and a voltage selection unit comprising a plurality of power transmission lines for outputting a plurality of voltages according to display data. The power transmission lines of the voltage selection unit are electrically connected to a plurality of driving units. Each driving unit comprises an output buffer and a switch. A first end of the switch is connected to either an output terminal of the output buffer or an input terminal of the output buffer. A second end of the switch is connected to an output terminal of the driving unit. The method comprises connecting the first end of the switch to the output terminal of the output buffer for driving an output voltage of the driving unit toward a voltage transmitted via the power transmission line of the voltage selection unit, and connecting the first end of the switch to the input terminal of the output buffer for driving the output voltage of the driving unit toward an average voltage generated from averaging voltages at output terminals of the driving units that are driven through the same voltage outputted from the same power transmission line.

In a second preferred embodiment, the claimed invention provides a method of driving a liquid crystal display monitor according to a line inversion method. The LCD monitor comprises an LCD panel for displaying a plurality of pixels arranged in a matrix format, and a voltage selection circuit comprising a plurality of output terminals for outputting a plurality of voltages. Each output terminal of the voltage selection circuit is selectively and electrically coupled to a driving unit. The driving unit comprises an output buffer, a first switch electrically connected to an output terminal of the output buffer and an output terminal of the driving unit, and a second switch connected to an output terminal of two adjacent driving units. The output terminal of the output buffer is electrically connected to the output terminal of the driving unit when the first switch is turned on, and the output terminal of one driving unit is electrically connected to the output terminal of another driving unit when the second switch is turned on. The method comprises turning on the first switch for driving an output voltage of the driving unit toward a voltage of the output terminal of the voltage selection unit that is connected to the driving unit, and turning on the second switch for driving the output voltage of the driving units toward an average voltage generated from averaging voltages at output terminals of the driving units when the driving units are connected to output terminals of the voltage selection unit that provide the same voltage.

In the third embodiment, the claimed invention provides a method of driving a liquid crystal display monitor according to a column inversion method, a dot inversion method, and a two dot line inversion. The third embodiment is based on the second preferred embodiment, and the principal difference is that the second switch is connected to output terminals of two driving units with at least one another driving unit positioned between the two driving units. Therefore, the two driving units connected by the second switch are prepared to drive corresponding pixels with voltages having the same polarity and drive the pixels to the same gray level.

The claimed invention further discloses a timing controller used to control the switches. The timing controller has a frequency divider, a counter, and a comparator for generating an output signal. A switch controller controls switches according to the output signal. In addition, an external clock generator can also be used to generate a clock signal to replace the output signal generated from the timing controller, and the switch controller uses the clock signal instead of the output signal to control switches. The operating voltages inputted into the operational amplifiers are cut off for saving power because the voltages inputted into pixels are averaged with the help of switches without being driven by the operational amplifiers anymore.

It is an advantage of the claimed invention that the pixels located in a row have the same target voltage so as to display data in a uniform gray level.

These and other objectives of the claimed invention will no doubt become obvious to those of ordinary skill in the art after reading the following detailed description of the preferred embodiment which is illustrated in the various figures and drawings.

DETAILED DESCRIPTION

Figure 1:
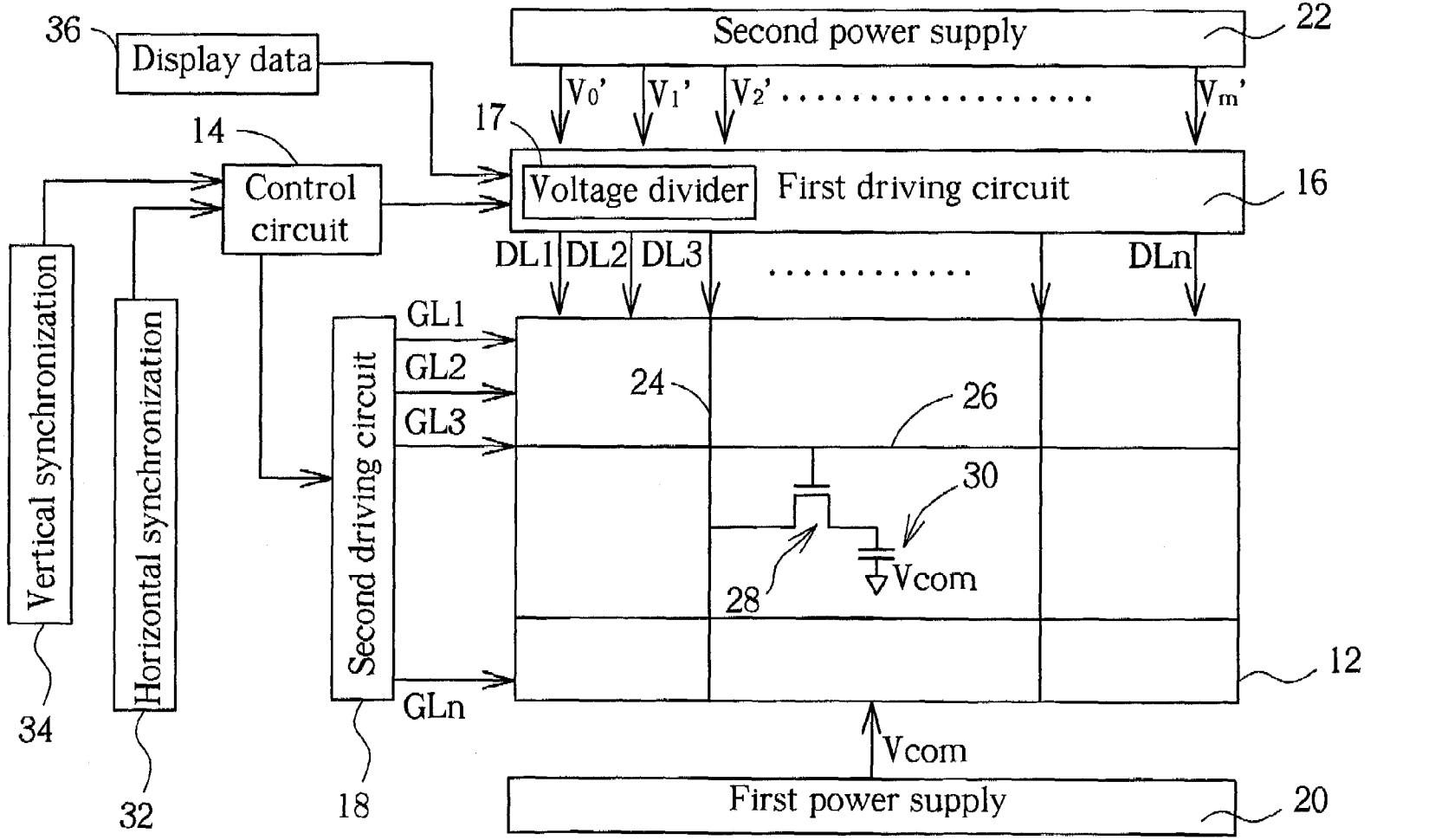
Fig. 1 Prior art
FIG. 1 is a schematic diagram of a conventional thin film transistor liquid crystal display monitor.
Figure 2:
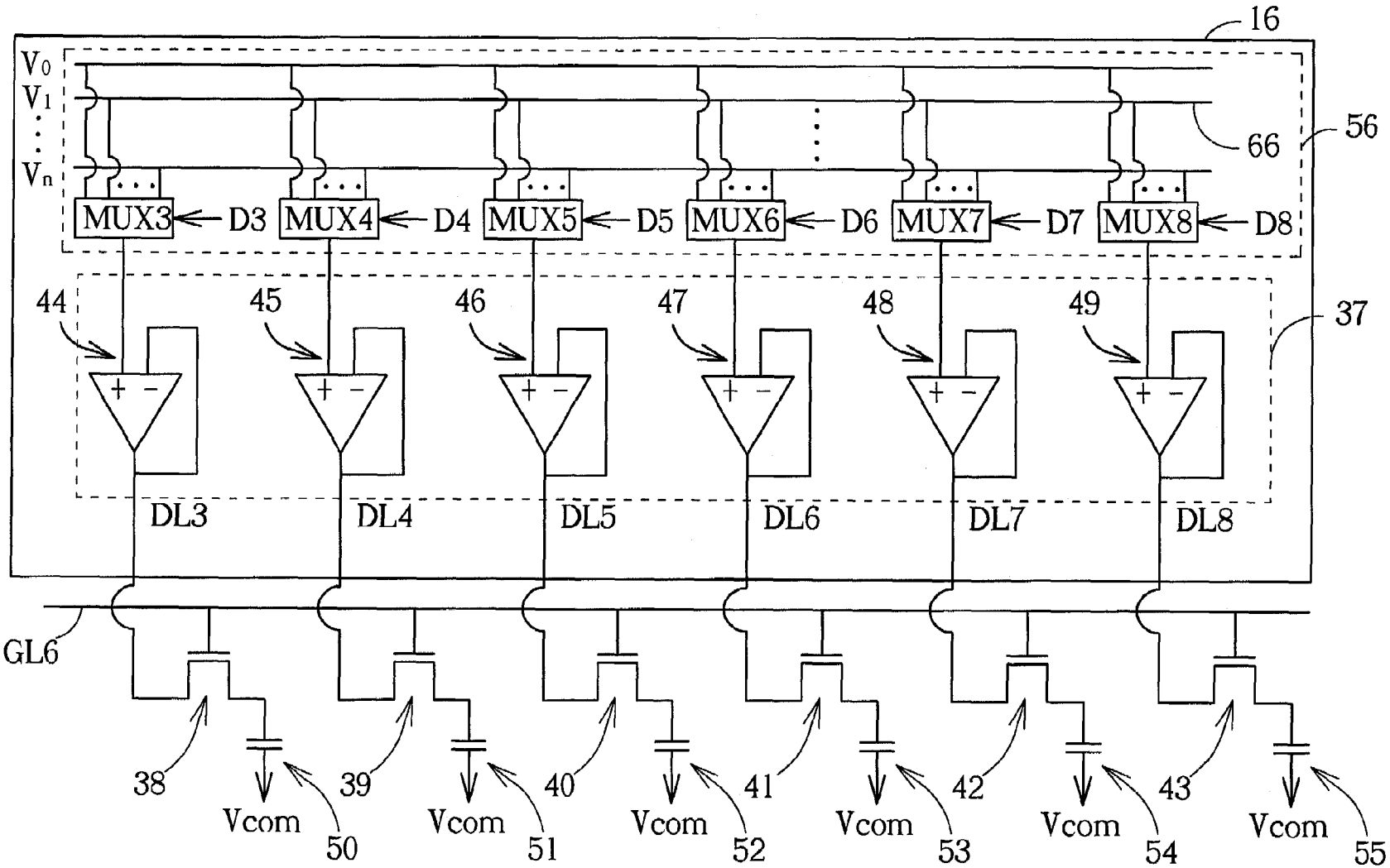
Fig. 2 Prior art
FIG. 2 is a schematic diagram of the first driving circuit shown in FIG. 1.
Figure 3:
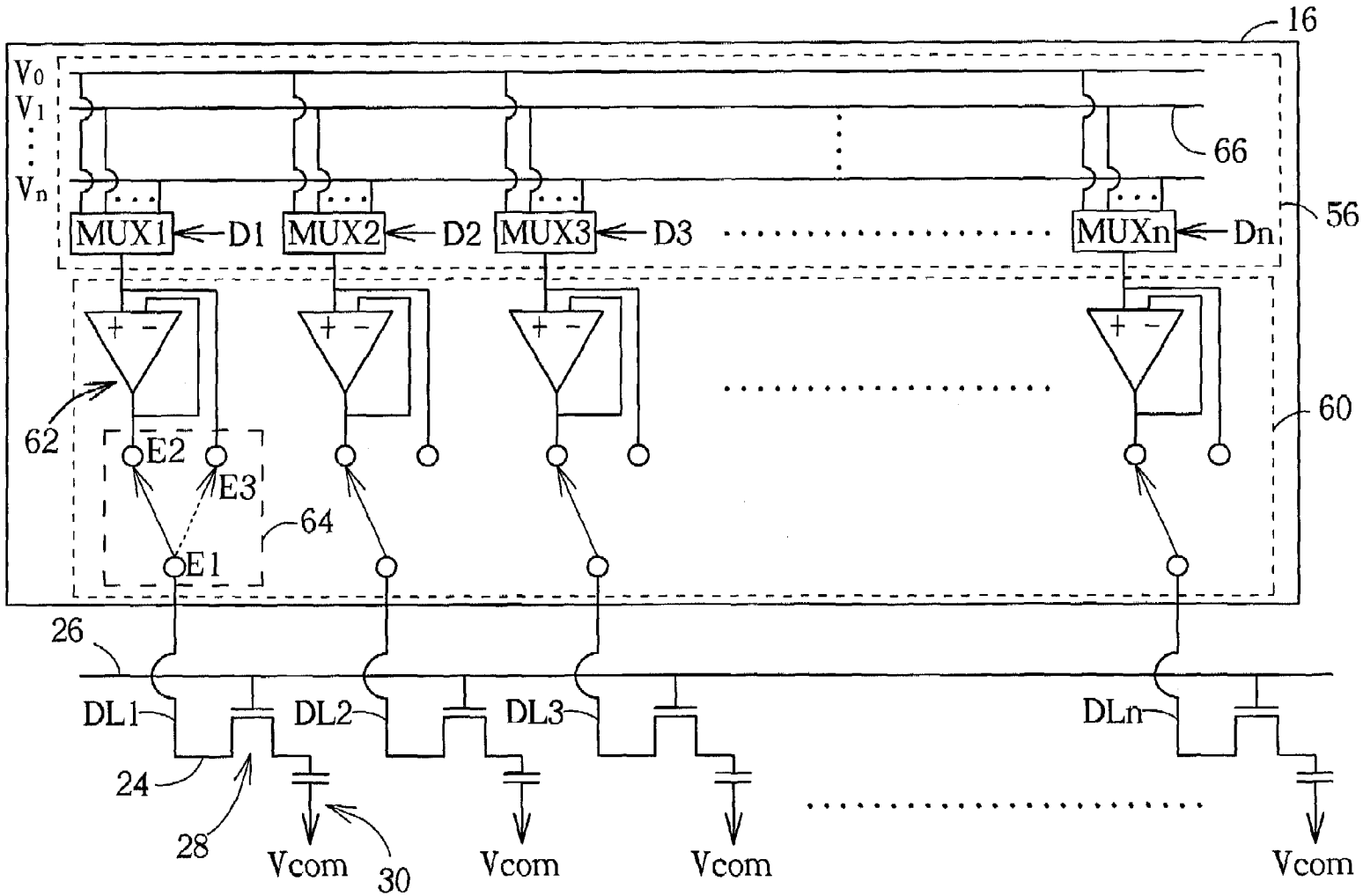
FIG. 3 is a schematic diagram of a first operational amplifier circuit according to the present invention.

Please refer to FIG. 1, FIG. 2, and FIG. 3. FIG. 3 is a schematic diagram of a first operational amplifier circuit 60 according to the present invention. The operational amplifier circuit 60 in the present invention is used to replace the operational amplifier circuit 37 located in the first driving circuit 16 shown in FIG. 2. Please note that the detailed operation of the voltage selection module 56 has been described before in the prior art section, and the lengthy description is not repeated again for simplicity. The operational amplifier circuit 60 comprises a plurality of operational amplifiers 62 or operational transconductance amplifiers (OTA) to form output buffers with a unity gain and a plurality of switches 64 for controlling current routes. When the second driving circuit 18 inputs a pulse to the gate lines 26 according to the horizontal synchronization 32, all thin film transistors 28 in the same gate line 26 conduct. Thus, the first driving circuit 16 respectively outputscorresponding voltages to DL1, DL2, DL3, . . . DLn in the data line 24 according to the display data 36 so as to display corresponding gray levels on the LCD panel 12. At this time, the multiplexer corresponding to the operational amplifier 62 is controlled to select a required voltage such as $V_1$, and the switch 64 is switched to conduct two ends E1 and E2 so that the voltage $V_1$ can drive the capacitor 30 through the operational amplifier 62. However, each operational amplifier 62 has a specific offset because of a semiconductor process mismatch, that is, each corresponding output voltage varies even the input voltage is the same for each operational amplifier 62, for example the input voltage is $V_1$. Thus, DL1, DL2, DL3, . . . DLn in the data line 24 have different voltage levels due to above-mentioned offset effect of the operational amplifiers 62. Therefore, different voltage levels are stored in each capacitors 30 corresponding to DL1, DL2, DL3, . . . , DLn of the data lines 24. Then, the switch 64 is switched to conduct the ends E1 and E3 to change current routes. Therefore, the voltage $V_1$ transmitted by the metal line 66 can not drive the capacitors 30 via the operational amplifier 62 owing to the status change of the switch 64. However, each capacitor 30 is connected to the same metal line 66 due to conducting the ends E1 and E3. Thus, all capacitors 30 are balanced quickly via the metal line 66 so as to have the same voltage level with an averaged offset.

For example, the switch 64 is switched to connect the ends E1 and E2 at first. If the voltage $V_1$ is 5V, the voltages of DL1, DL2, DL3, and DL4 in the data line 24 are driven toward 5V via the output buffers formed by the operational amplifiers 62. However, the voltages of DL1, DL2, DL3, and DL4 of the data line 24 vary differently because the offset related to each operational amplifiers 62 is different. For example, the voltages at DL1, DL2, DL3, and DL4 of the data line 24 are 4.8V, 5.1V, 4.7V and 4.9V respectively. At this time, the switch 64 is switched to connect the ends E1 and E3. Since DL1, DL2, DL3, and DL4 of the data line 24 are electrically connected to the same metal line 66 via the ends E1 and E3, therefore, the voltages of DL1, DL2, DL3, DL4 of the data line 24 will generate an average voltage rapidly. In other words, each voltage of DL1, DL2, DL3, and DL4 of the data line 24, which are originally 4.8V, 5.1V, 4.7V and 4.9V respectively, come to an average voltage via the metal line 66. It is noteworthy that original different offsets are averaged to generate an identical offset for each data line 24 mentioned above, and the input voltage is then affected by the same averaged offset to generate the average voltage at each data line 24. In addition, the pixels positioned in the same row will have the same gray level when the pixels are driven by the same voltage generated by the voltage divider 17.

Figure 4:
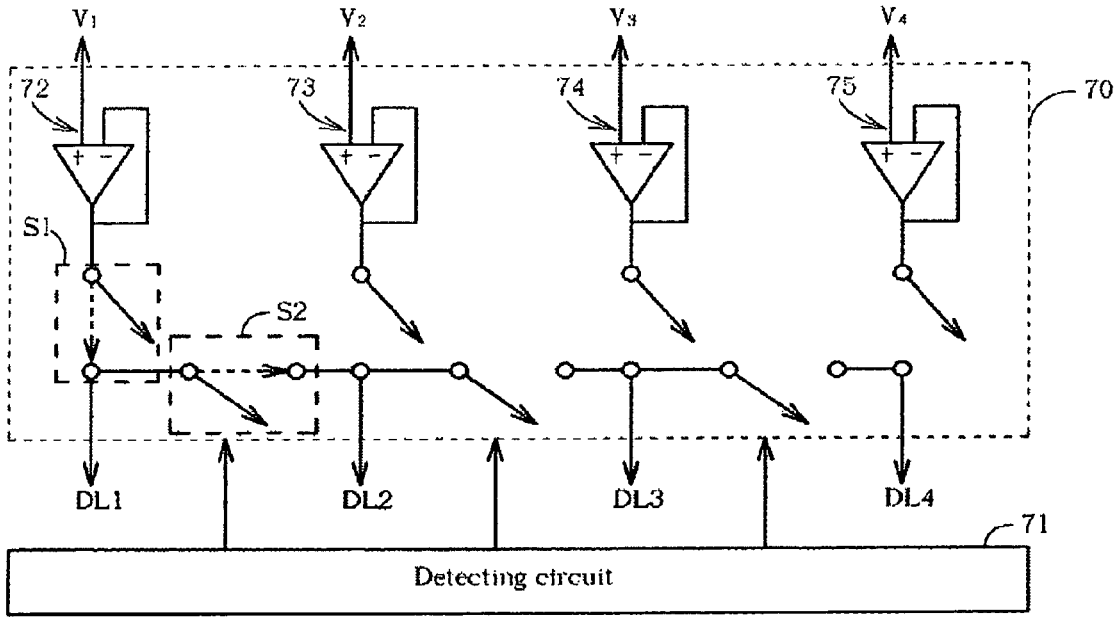
FIG. 4 is a schematic diagram of a second operational amplifier circuit according to the present invention.

Please refer to FIG. 4, which is a schematic diagram of a second operational amplifier circuit 70 according to the present invention. The second operational amplifier circuit 70 has a plurality of operational amplifiers 72, 73, 74, and 75 to function as output buffers, and a plurality of switches S1, S2 related to the operational amplifiers 72, 73, 74, and 75. Please note that only four operational amplifiers are drawn in FIG. 4 for simplicity, and the operational amplifiers 72, 73, 74, and 75 and switches S1, and S2 are used to drive corresponding pixels through data lines DL1, DL2, DL3, and DL4. The operation of the second operational amplifier circuit 70 is described as follows. In the beginning, each switch S1 is first turned on to make the operational amplifiers 72, 73, 74, and 75 electrically connected to corresponding data lines DL1, DL2, DL3, and DL4. As mentioned before, each operational amplifier 72, 73, 74, and 75 has a unique offset respectively affecting the output voltage to deviate from the input voltage. In other words, if the pixels with regard to the operational amplifiers 72, and 73 are prepared to be driven by the same input voltage level, for instance V1, the voltage levels of the data lines DL1, and DL2 are different owing to the respective offsets corresponding to the operational amplifiers 72, and 73. Then, all the switches S1 related to the operational amplifiers 72, 73, 74, and 75 are turned off simultaneously. Next, if the operational amplifiers 72, and 73 prepare to drive corresponding pixels toward the same gray level through data lines DL1, and DL2, the switch S2 related to the operational amplifiers 72, and 73 is then turned on by a detecting circuit 71. That is, the detecting circuit 71 controls an on/off status of each switch $S_2$ according to digital or analog driving data with regard to two pixels coupled to the switch $S_2$. Therefore, the voltage levels of the data lines DL1, and DL2 will quickly approach an average voltage from these two voltage levels. That is, the original offsets are averaged to generate the average voltage for the data lines DL1, and DL2. Similarly, if the operational amplifiers 73, and 74 prepare to drive corresponding pixels toward the same gray level through data lines DL2, and DL3, the switch S2 related to the operational amplifiers 73, and 74 is then turned on as well. Therefore, any adjacent pixels driven by the same input voltage will finally have the same gray level with the help of switch S2. To sum up, voltage at each data line DL1, DL2, DL3, or DL4 is first driven by a corresponding operational amplifier 72, 73, 74, or 75 after the switch S1 related to each operational amplifier 72, 73, 74, or 75 is turned on. Then, each switch S1 is turned off. In addition, the switch S2 is turned on when related adjacent pixels related to the switch S2 are prepared to have the same gray level. Finally, the voltage deviation between the adjacent data lines is eliminated by averaging the offsets generated by the corresponding operational amplifiers through the switch S2. In the preferred embodiment, the second operational amplifier circuit 70 is applied on a LCD panel driven according to a line inversion method. Because the pixels positioned in the same row will have the same polarity according to the line inversion method, the switch S2 is capable of averaging voltages with the same polarity at adjacent data lines such as data lines DL1, and DL2. In addition, the different offsets are not averaged through the voltage selection module 56 shown in FIG. 3 but are averaged through the related switch S2. Therefore, any voltage divider circuit that can provide the operational amplifier circuit 70 with different voltage levels is suitable for the first driving circuit 16 in the preferred embodiment.

Figure 5:
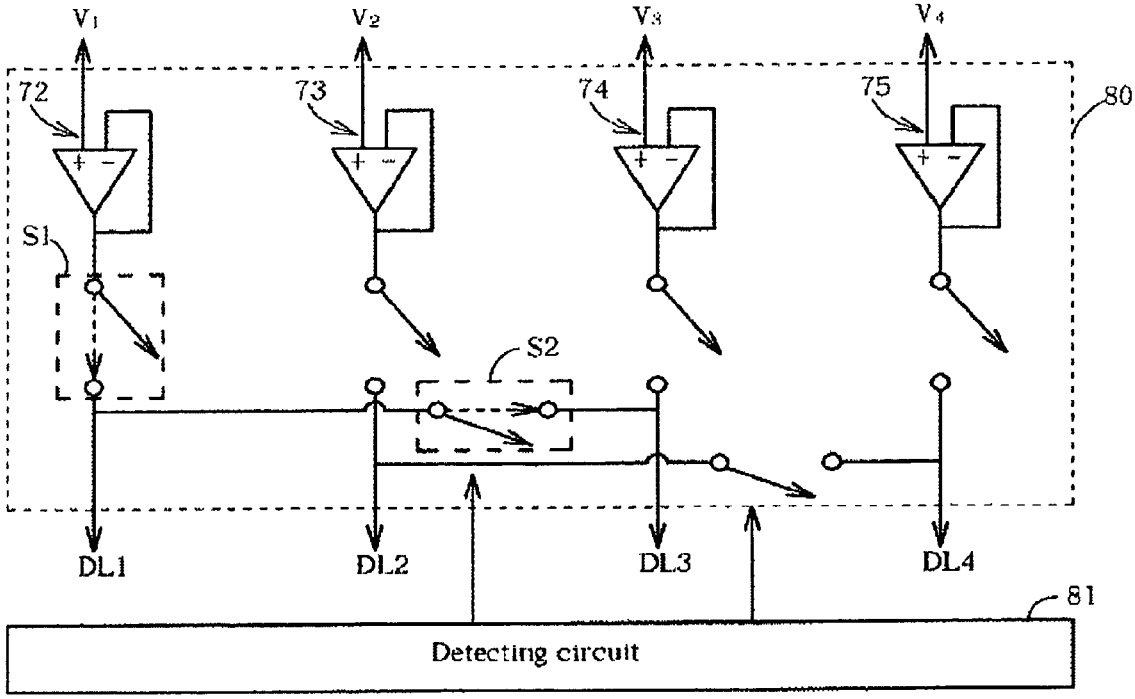
FIG. 5 is a schematic diagram of a third operational amplifier circuit according to the present invention.

Please refer to FIG. 5, which is a schematic diagram of a third operational amplifier circuit 80 according to the present invention. The third operational amplifier circuit 80 is similar to the second operational amplifier circuit 70. Only the arrangement of the switches S1, and S2 is different. As shown in FIG. 5, there is a switch S2 electrically connected to the operational amplifiers 72, 74, and another switch S2 is electrically connected to the operational amplifiers 73, 75. That is, the adjacent data lines such as DL1, and DL2 are not connected through the switch S2. When pixels are driven by a dot inversion method, a two dot line inversion method, or a column inversion method, adjacent pixels in the same row are driven by voltages with opposite polarities. That is, pixels connected to lines DL1, DL2, DL3, and DL4 respectively have polarities such as "+""−""+""−" or "−""+""−""+". Therefore, the third operational amplifier circuit 80 uses switches S2 connected to adjacent operational amplifiers that have the same polarity for averaging above-mentioned offsets when corresponding pixels with the same polarity are driven to the identical gray level. For example, if the pixels connected to the data lines DL1, and DL3 are going to have the same gray level, the switches S1 corresponding to operational amplifiers 72, and 74 are first turned on in the beginning. Because the offsets related to the operational amplifiers 72, and 74 are different, the voltages at the data lines DL1, and DL3 are different as well. Then, the switch S2 related to the lines DL1, and DL3 is turned on by a detecting circuit 81. That is, the detecting circuit 81 controls an on/off status of each switch $S_2$ according to digital or analog driving data with regard to two pixels coupled to the switch $S_2$. Therefore, the voltage deviation between the lines DL1, and DL3 is eliminated by averaging the offsets generated by the corresponding operational amplifiers 72, and 74. It is noteworthy that the offsets generated from the operational amplifiers 72, and 74 are averaged to generate an average voltage at both lines DL1, and DL3. In other words, the lines DL1, and DL3 still have an averaged offset according to the present invention. But, the voltages at data lines DL1, and DL3 are equal after all. In addition, if two adjacent pixels are not going to have the same gray level, the switch S2 related to the corresponding pixels is kept off without affecting the gray levels of the adjacent pixels. In the preferred embodiment, the switch S2 is connected to two data lines driven according to the same polarity, and these two data lines is spaced by another data line driven according to an opposite polarity. That is, the third operational amplifier circuit 80 is applied on an LCD panel driven by a column inversion method, a dot inversion method, or a two dot line inversion. In addition, the different offsets are not averaged through the voltage selection module 56 shown in FIG. 3 but are averaged through the related switch S2. Therefore, any voltage divider circuit that can provide the operational amplifier circuit 70 with different voltage levels is suitable for the first driving circuit 16 in the preferred embodiment.

Figure 6:
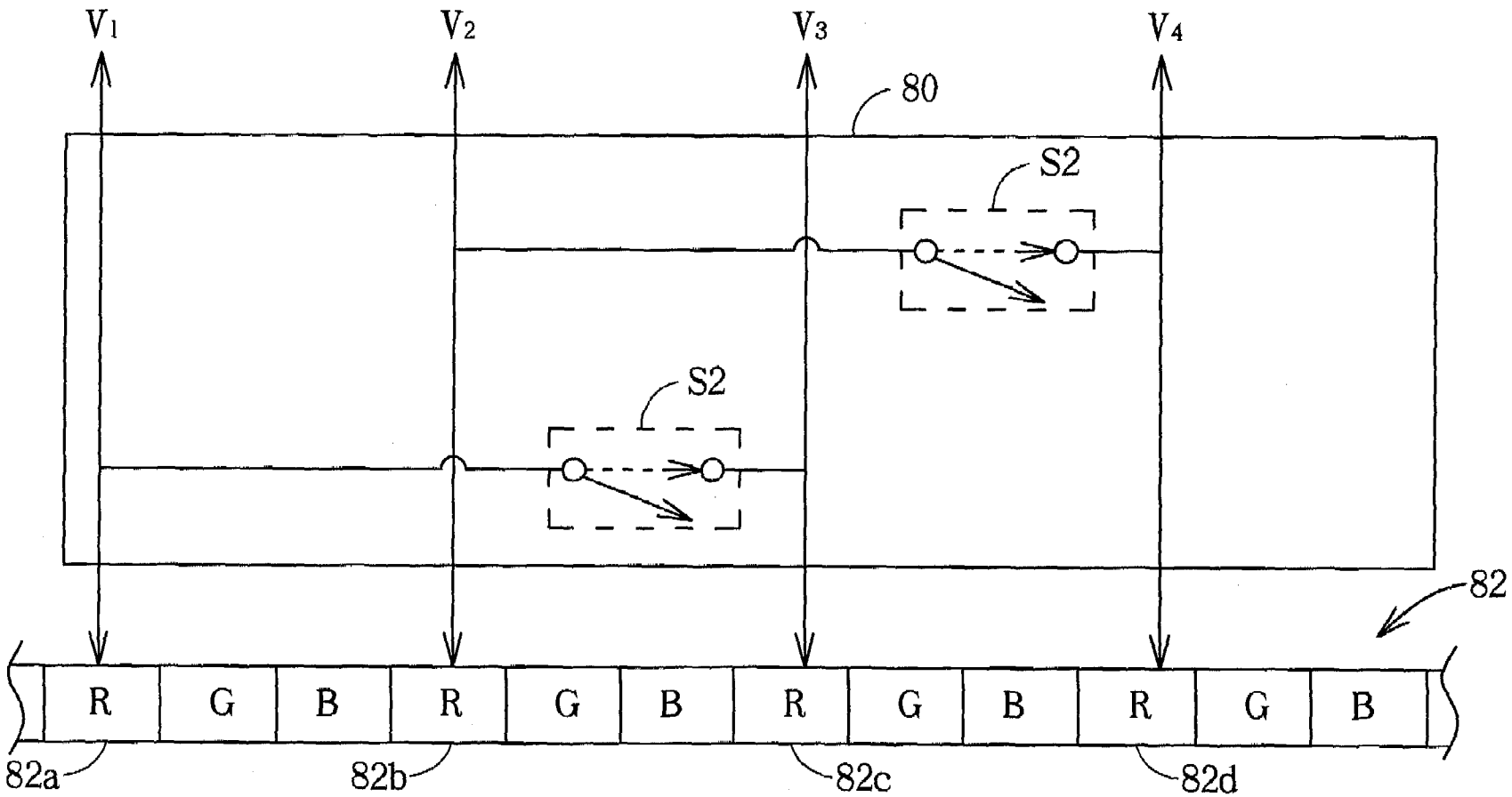
FIG. 6 is a simplified diagram of a connection between pixels and the third operational amplifier circuit shown in FIG. 5.

Please refer to FIG. 6, which is a simplified diagram of a connection between pixels 82 and the third operational amplifier circuit 80 shown in FIG. 5. A specific color is generated by mixing three monochromatic lights such as a red light, a green light, and a blue light respectively having different intensities. Therefore, pixels 82 located at the same row are individually responsible for providing a gray level with regard to the red light, the green light, or the blue light. As shown in FIG. 6, there are pixels 82 used to represent a color sequence "RGBRGBRGBRGB". When the pixels 82 are driven according to a dot inversion method, a two dot line inversion method, or a column inversion method, adjacent pixels 82 will have opposite polarities. For example, the pixels 82 are driven according to a polarity sequence "+−+−+−+−+−+−". Concerning the red light, the pixels 82*a* and 82*c* have the same polarity "+", and the pixels 82*b* and 82*d* have the same polarity "−". For the pixels 82*a*, 82*b*, 82*c*, and 82*d* with regard to the red light, one switch S2 is connected between the pixels 82*a* and 82*c* driven by the same polarity "+". In addition, another switch S2 is connected between the pixels 82*b* and 82*d*. Therefore, when the third operational amplifier circuit 80 is used to drive pixels with regard to one specific monochromatic light, a switch S2 is responsible for equaling voltages inputted into two adjacent pixels driven by the same polarity and driven to the same gray level. It is noteworthy that the above-mentioned driving method is also applied on driving pixels with regard to green light and blue light, and the repeated description is skipped for simplicity.

The voltage selection module 56 shown in FIG. 3 is used to provide the operational amplifier circuit 60 with appropriate voltage levels. In addition, the metal lines 66 within the voltage selection module 56 not only transmit electric power but also average voltage levels at different data lines 24. That is, the pixels located at different positions in the same row will have the same gray level when driven by the same voltage provided by the voltage selection module 56. The metal line 66 performs a global voltage average operation. The operational amplifier circuits 70, and 80 shown in FIG. 4 and FIG. 5 use switches S2 to perform the local voltage average operation. That is, the switch S2 is turned on only when two adjacent pixels related to the switch S2 are prepared to be driven by an identical voltage level. Users are only sensitive to gray level difference between adjacent pixels, but are not sensitive to the gray level of each pixel. Therefore, the objective of the operational amplifier circuits 70, and 80 is to eliminate the gray level difference between adjacent pixels when the adjacent pixels are driven by the same voltage level. That is, switches S2 of the operational amplifier circuits 70, and 80 take place of the metal lines 66 located in the voltage selection module 56 for eliminating voltage deviations between two adjacent pixels only to achieve a uniform gray level.

As mentioned above, the second operational amplifier circuit 70 is applied on an LCD monitor driven by a line inversion method, and the third operational amplifier circuit 80 is applied on an LCD monitor driven by a column inversion method, a dot inversion method, or a two dot line inversion. Therefore, the operational amplifier circuit according to the present invention can be applied on an LCD monitor, which is driven according to a predetermined method, to solve the offset deviation problem. In addition, the TFT LCD according to the present invention further comprises a XOR logic circuit or a comparator to determine whether the switche S2 is turned on or not. That is, the XOR logic circuit is used to compare digital input driving data related two pixels to check whether the pixels are going to have the same gray level, and the comparator is used to compare analog input driving data related to two pixels to check whether the pixels are going to have the same gray level. When the XOR logic circuit or the comparator acknowledges that two pixels are prepared to be driven toward the same gray level, the switch S2 related to the pixels will be turned on to eliminate the offset deviation. In other words, the TFT LCD has a detecting circuit such as a XOR logic circuit for digital driving data or a comparator for analog driving data to compare driving data with regard to two pixels. When these two pixels are going to have the same gray level, the switch S2 related to these two pixels is turned on according to a comparison result generated from the XOR logic circuit or the comparator. Furthermore, the present invention is capable of using operational transconductance amplifiers instead of the operational amplifiers to drive the pixels.

Figure 7:
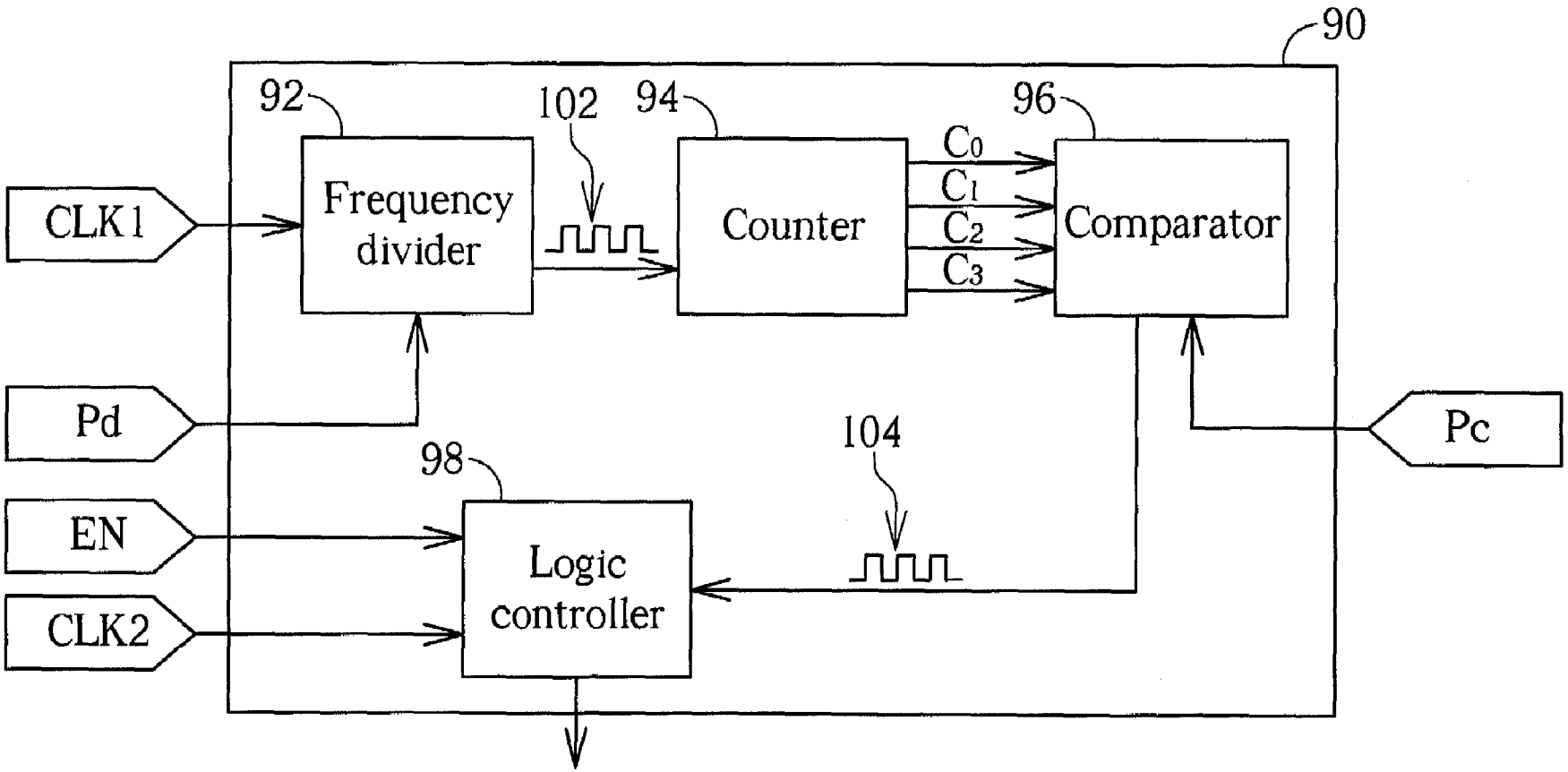
FIG. 7 is a block diagram of a timing controller according to the present invention.

The switches 64 shown in FIG. 3 and switches S1, S2 shown in FIGS. 4~6 are controlled by a timing controller of the present invention. That is, the timing controller teams up with the control circuit 14 shown in FIG. 1 to drive the LCD panel 12 properly. Please refer to FIG. 7, which is a block diagram of a timing controller 90 according to the present invention. The timing controller 90 comprises a frequency divider 92, a counter 94, a comparator 96, and a logic controller 98. Operation of the timing controller 90 is described as follows. The frequency divider 92 will divide frequency of a clock signal CLK1 inputted into the frequency divider 92 by a divisor N1. The value of the divisor N1 is determined and set by a control signal Pd. For example, the control signal Pd having a corresponding binary data "00", "01", "10", or "11" will set the value of the divisor N as "1", "2", "3", or "4" respectively. If the frequency of the clock signal CLK is f1, an output signal 102, therefore, has a corresponding frequency f2 equal to f1/N1. That is, when the frequency f1 is 108 KHz, and the control signal Pd with a corresponding binary data "11" is inputted into the frequency divider 92, the frequency f2 of the output signal 102 will become 27 (108/4) KHz. In other words, the output signal 102 is adjustable based on the clock signal CLK1 with different frequency values and different divisor settings. Then, the output signal 102 is transmitted to the counter 94. The counter 94 is used to count the output signal 102 based on a predetermined count value N2. For example, when a signal triggers the counter 94 for a predetermined number of times, the counter 94 will output predetermined data C0, C1, C2, and C3 to the comparator 96. That is, a different count value N2 corresponds to different data outputted via C0, C1, C2, and C3. For example, when the counter 94 is triggered by the output signal 102 for 216 times, binary data C0, C1, C2, and C3 having values "1","0","1", and "0" respectively are transmitted to the comparator 96. Because the frequency f2 of the output signal 102 is equal to 27 KHz as mentioned above, the output signal 102 will trigger the counter 94 about 27K times per second. Therefore, the counter 94 will output "1", "0", "1", and "0" for C0, C1, C2, and C3 after 8 ms. The comparator 96 will compare the values transmitted by C0, C1, C2, and C3 with a comparing value N3 that is determined and set by a control signal Pc. For example, when the control signal Pc with a binary data "10" is inputted into the comparator 96, the comparing value N3 will be set to "1010". When the values transmitted by C0, C1, C2, and C3 match the comparing value N3, the comparator 96 will generate a voltage level transition. For example, before the counter 94 outputs C0, C1, C2, and C3 with values "1", "0", "1", and "0", the comparator 96 originally outputs value "1". After the output signal 102 triggers the counter 94 with the count value N2, the counter 94 outputs C0, C1, C2, and C3 with values "1", "0", "1", and "0". After the comparator 96 detects that the data transmitted by C0, C1, C2, and C3 (1010) is equal to the comparing value N3 (1010), the comparator 96 will generate a transition from "1" to "0". With the help of a control signal EN, the logic controller 98 can select either the output signal 104 outputted from the comparator 96 or a clock signal CLK2 generated by an external clock generator. As described above, the output signal 104 is generated through the frequency divider 92, the counter 94, and the comparator 96 positioned inside the timing controller 90. However, the output signal 104 such as the clock signal CLK2 shown in FIG. 7 could be directly generated by an external clock generator. The clock signal CLK2 has the same waveform as the output signal 104. Thus, the logic controller 98 determines whether the internal output signal 104 or the external clock signal CLK2 is used based on the control signal EN. For example, when the control signal EN has a binary value "1", the internal output signal 104 is chosen. On the contrary, when the control signal EN has a binary value "0", the external clock signal CLK2 is chosen. It is noteworthy that the selection defined by the control signal EN is adjustable. In other words, when the control signal EN has a binary value "0", the internal output signal 104 is chosen. On the contrary, when the control signal EN has a binary value "1", the external clock signal CLK2 is chosen. To sum up, the user can feed the logic controller 98 with the internal output signal 104 or the external clock signal CLK2 for meeting any types of LCD monitors" driving requirements. Either the output signal 104 of the comparator 96 or the external clock signal CLK2 is used by the logic controller 98 to control the switches 64 shown in FIG. 3 and the switches S1, S2 shown in FIGS. 4~6. That is, when the voltage level of the output signal 104 or the external clock signal CLK2 changes from one level to another level, the average operation performed on voltages for driving pixels toward the same gray level as mentioned above is activated.

Figure 8:
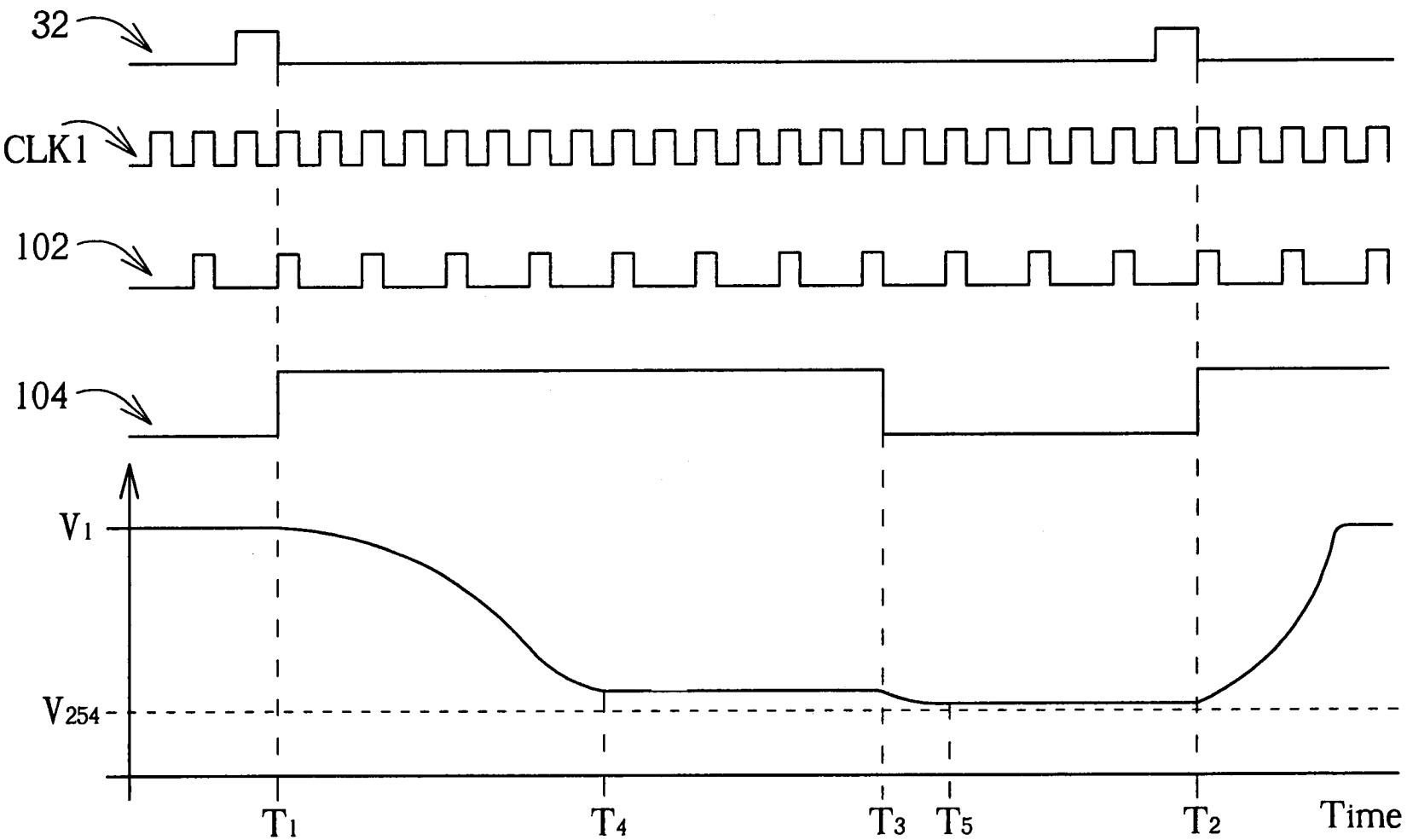
FIG. 8 is a timing diagram of the timing controller.

Please refer to FIG. 8, which is a timing diagram of the timing controller 90. The first waveform represents the horizontal synchronization signal 32 shown in FIG. 1 for determining activation of one gate line 26. Each gate line 26 is triggered by the horizontal synchronization signal 32 to be active for driving the pixels located at the same active gate line 26. At falling edge of the horizontal synchronization signal 32 related to one gate line 26, the corresponding gate line 26, for example, will be activated by the second driving circuit 18, and the first driving circuit 16 starts to drive the pixels located at the gate line 26 toward specific gray levels related to the pixels. Each gate line 26 is driven sequentially and cyclically, that is, one gate line 26 is driven periodically by the horizontal synchronization signal 32. As shown in FIG. 8, one gate line is activated at time T1 for one driving period, and another gate line will be activated at time T2 for its driving period. The interval between time T2 and T1 is a period of the horizontal synchronization signal 32 related to the corresponding gate line 26. The second waveform represents the clock signal CLK1, and the third waveform represents the output signal 102 generated from the frequency divider 92 shown in FIG. 7. It is obvious that the frequency of the output signal 102 is half of the frequency of the clock signal CLK1. In other words, the control signal Pd is inputted into the frequency divider 92 to set the divisor N1 as 2. If the count value N1 that is predetermined to be 8 is obtained by the counter 94, the corresponding values C0, C1, C2, and C3 will be outputted to the comparator 96. Therefore, the control signal Pc is also inputted into the comparator 96 to set the comparing value N3 corresponding the values C0, C1, C2, and C3 related to the count value N1. As shown in FIG. 8, the fourth waveform represents the output signal 104, and the output signal 104 holds a value "1" before the counter 94 achieves the predetermined count value N2 that is equal to 8. However, when the count value N1 equal to 8 is achieved by the counter 94, the output signal 104 has a transition from "1" to "0" at time T3, and the output signal 104 will keep a value "0" during time T3 to time T2. After the horizontal synchronization signal 32 activates another gate line at time T2, the counter 94 and the comparator 96 are reset to their initial states. That is, the counter 94 recounts the output signal 102, and the comparator 96 outputs the output signal 104 with a corresponding original value "1". The fifth waveform represents driving voltage of one data line. At time T1, the first driving circuit 16 starts driving the pixel from voltage $V_1$ to a target voltage $V_{254}$ when the pixel is alternatively driven by opposite polarities to reduce well-known flicker problem. Talking about the switches 64 shown in FIG. 3, the switches 64 are controlled by the logic controller 98 to connect nodes E1 and E2 according to the output signal 104. That is, when the output signal 104 has a transition from "0" to "1", the logic controller 98 makes the switches 64 connect the nodes E1 and E2. The pixel is driven by the corresponding operational amplifier 62 based on the voltage $V_{254}$. Therefore, the driving voltage inputted into the pixel will approach voltage $V_{254}$ after time T4. The output signal 104 has a transition from "1" to "0" at time T3, and the logic controller 98 acknowledges this transition at the same time. The logic controller 98 controls the switches 64 to connect the nodes E1 and E3 after time T3. As mentioned before, because the pixels driven by the same driving voltage $V_{254}$ are connected together through a metal wire corresponding to the voltage $V_{254}$, the voltages applies on pixels predetermined to be driven to the same voltage level ($V_{254}$) are averaged toward a voltage ($V_a$ for example)close to $V_{254}$ after time T5. After time T2, the pixel, however, will be driven to another voltage with opposite polarity compared with the previous driving operation. As described above, the frequency divider 92, the counter 94, and the comparator 96 are used to generate the output signal 104, and the logic controller 98 controls switches 64 shown in FIG. 3 based on the output signal 104. The duration of the output signal 104 having a value "1" between time T1 to time T3 is adjustable by choosing appropriate divisor N1, count value N2, and comparing value N3. In addition, the operational amplifiers 62 are no longer used to drive pixels in the preferred embodiment. The operating voltages such as bias voltages inputted into the operational amplifiers 62 are cut off during time T3 and time T2 in the preferred embodiment for reducing total power consumption. Because different LCD monitors have specific loadings, that is, one LCD monitor might spend more time on driving pixels than other LCD monitors. The duration from time T1 to time T3 defines a driving period for the operational amplifiers 62. For the LCD monitor with a small loading, the required duration from time T1 to time T3 is shorter. Therefore, the timing controller 90 can be adjusted to have a shorter duration between time T1 and time T3. The operating voltages related to the operational amplifiers 62 is cut off during time T3 and time T2 for saving power. Similarly, for the LCD monitor with a large loading, the required duration from time T1 to time T3 is longer. Therefore, the timing controller 90 can be adjusted to have a longer duration between time T1 and time T3 for the operational amplifiers 62 to drive pixels toward a target voltage successfully. The operating voltages related to the operational amplifiers 62 is cut off during time T3 and time T2 for saving power as well. From the above description, the same timing controller 90 of the present invention can be applied on different LCD monitors with different loadings, and the output signal 104 is adjustable to meet requirement of each LCD monitor for an optimal power saving capacity. The driving sequence of the switches S1 and S2 shown in FIGS. 4~6 is similar to the switches 62 shown in FIG. 3. During time T1 and time T3, the switches S1 are turned on so that the operational amplifiers 72, 73, 74, 75 can drive corresponding pixels. At time T3, the switches S1 are turned off, and the switches S2 each related to two adjacent pixels driven toward the same gray level by the same driving voltage inputted into the operational amplifiers before time T3 are simultaneously turned on. The voltages inputted into the adjacent pixels are averaged during time T3 to time T2. Similarly, the operational amplifiers 72, 73, 74, 75 are no longer used to drive pixels. In the preferred embodiment, the operating voltages such as bias voltages inputted into the operational amplifiers 72, 73, 74, 75 are cut off for saving power. Moreover, the power applied to the second power supply 22 and/or the voltage divider 17 also can be cut off for saving more power. Besides, the duration from time T1 to T3 is adjustable based on loading of the LCD monitor. With appropriate settings of divisor N1, count value N2, and comparing value N3 for the timing controller 90, the LCD monitor can save optimal power.

In contrast to the prior art, the driving method according to the present invention uses a switch to connect the output terminals of the output buffers. Therefore, the power supply generates a target level to drive some pixels located in a row of the LCD panel toward the same target level. There are different offsets between the output levels of the driving units for driving those pixels toward the same target level. When the output terminals of the output buffers are connected together via the switches, the original different output levels of driving units of corresponding pixels are changed towards an average voltage generated from averaging voltages at output terminals of the driving units of the pixel. Although the average voltage may be not exactly equal to the target level, those pixels, which are located in the same row and are predetermined to be driven toward the same target level, are driven to the same level by using the method of the present invention. Thus, the uniformity problem in the prior art caused by level offsets can be solved. In addition, when the voltage averaging operation starts working, the related output buffers such as power amplifiers are not used for driving pixels during the voltage averaging operation. Therefore, the driving method according to the present invention cuts off any operating voltages such as bias voltages inputted into the output buffers for reducing power consumption. Furthermore, the driving method according to the present invention uses a timing controller to determine activation timing of the voltage averaging operation. The activation timing is adjustable by appropriate settings inputted to the timing controller for meeting different loading of LCD monitors. With suitable activation timing setting, the corresponding LCD monitor can have an optimal power saving capacity.

Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A method of driving a liquid crystal display (LCD) device, the method comprising:

(a-0) providing the LCD device with an LCD panel for displaying a plurality of pixels arranged in a matrix format, a voltage selection circuit for outputting a plurality of driving voltage levels according to display data, a timing controller, and a plurality of output buffers, each output buffer electrically coupled between the voltage selection circuit and the LCD panel;

driving pixels located in a row by corresponding output buffers according to corresponding driving voltage levels generated from the voltage selection circuit for driving the corresponding pixels of the LCD;

(b) disconnecting the pixels from the corresponding output buffers; and (c) connecting the pixels driven by the same driving voltage level for equalizing voltages applied on the pixels, and turning off operating voltages inputted into the corresponding output buffers for stopping the output buffers from processing the corresponding driving voltage levels;

wherein the timing controller controls the driving sequence of steps (a), (b), and (c), and the timing controller comprises: a frequency divider for dividing the frequency of a clock signal according to a predetermined divisor; a counter for counting the divided clock signal to generate a count value; a comparator for comparing the count value with a predetermined number to generate a comparison result; and a logic controller comprising a first input port for receiving the comparator result to determine timing to perform steps (b) and (c).

2. The method of claim 1, wherein each output butter is an operational amplifier.

3. The method of claim 1, wherein the voltage selection circuit comprises a plurality of conductive wires each for carrying one of the driving voltage levels and a plurality of digital-to-analog decoders (DACs) each for selecting one of the driving voltage levels from the conductive wires according to display data.

4. The method of claim 3, wherein the LCD device further comprises a plurality of switches each selectively connecting an output terminal of the output buffer to a corresponding pixel or connecting an input terminal of the output buffer, to a corresponding pixel.

5. The method of claim 4, wherein step (a) is performed by connecting the output terminal of the output buffer to the corresponding pixel.

6. The method of claim 4, wherein step (b) is performed by connecting the input terminal of the output buffer to the corresponding pixel.

7. The method of claim 4, wherein step (c) the pixels predetermined to be driven to the same driving voltage level are connected to the same conductive wire which delivers corresponding driving voltage level.

8. The method of claim 1, wherein the LCD device further comprises:

a plurality of first switches each connected between an output terminal of a corresponding output buffer and a corresponding pixel; and a plurality of second switches each connected between two pixels for selectively connecting the two pixels.

9. The method of claim 8, wherein step (a) is performed by: turning on each first switch in the row for connecting the output buffer to the corresponding pixel; and turning off each second switch in the row.

10. The method of claim 8, wherein step (b) is performed by turning off each first switch in the row.

11. The method of claim 8, wherein step (c) is performed by selectively turning on the second switches on the row.

12. The method of claim 1, wherein the LCD device further comprises a timing controller for controlling the driving sequence of steps (a), (b), and (c).

13. The method of claim 1, wherein when the count value is equal to the predetermined number, the comparison result generates a voltage level transition, and step (b) and step (c) are performed.

14. The method of claim 1, wherein the frequency divider comprises an input port for receiving an input data to set the predetermined divisor.

15. The method of claim 1, wherein the comparator comprises an input port for receiving an input data to set the predetermined number.

16. The method of claim 1, wherein the logic controller further comprises a second input port for receiving an external clock signal, and the logic controller determines whether to perform steps (b) and (c) according to the external clock signal.

17. The method of claim 16, wherein the logic controller further comprises a third input port for receiving a selecting signal, and the selecting signal is used for controlling the logic controller to adopt either the comparison result or the external clock signal.

18. A liquid crystal display (LCD) device comprising:

an LCD panel for displaying a plurality of pixels arranged in a matrix format;

a voltage selection circuit for outputting a plurality of driving voltage levels according to display data;

a plurality of output buffers, each output buffer electronically coupled between the voltage selection circuit and the LCD panel for driving the corresponding pixel by corresponding driving voltage level; and a timing controller for controlling driving of the pixels, the timing controller comprising:

a frequency divider for dividing the frequency of a clock signal according to a predetermined divisor;

a counter for counting die divided clock signal to generate a count value; and a comparator for comparing the count value with a predetermined number;

wherein the output buffers are disconnected from the corresponding pixels, operating voltages inputted into the output buffers are turned off and the pixels that are driven by the same driving voltage levels are connected for averaging the voltage applied on the pixels according to the predetermined number.

19. The LCD device of claim 18, wherein the frequency divider comprised an input port for receiving an input data to set the predetermined divisor.

20. The LCD device of claim 18, wherein the comparator comprises an input port for receiving an input data to set the predetermined number.

21. The LCD device of claim 18 wherein the timing controller further comprises a logic controller, and the logic controller comprises a first input port for receiving a comparison result outputted from the comparator to determine whether the count value is equal to the predetermined number or not.

22. The LCD device of claim 21 wherein the logic controller further comprises a second input port for receiving a control signal, and the logic controller determines whether the output buffers are disconnected from the corresponding pixel, and the pixels that are driven by the same driving voltage level are connected for averaging the voltage inputted into the pixels according to the control signal.

23. The LCD device of claim 22 wherein the logic controller further comprises a third input port for receiving a selecting signal, and the selecting signal is used for controlling the logic controller to adopt either the comparison result or the control signal.

24. A driving device for driving a liquid crystal display (LCD) device, the LCD device comprising an LCD panel having a plurality of pixels arranged in a matrix format, said driving device comprising:

a plurality of decoders each for selectively outputting one of a plurality of voltages according to display data;

a plurality of driving units each electrically connected to one of said decoders, said driving unit comprising:

an output buffer;

a first switch connected between an output terminal of said output buffer and an output terminal of said driving unit, the output terminal of said output buffer being electrically connected to the output terminal of said driving unit when said first switch is turned on; and a second switch connected between the output terminal of said driving unit and an output terminal of another driving unit, the output terminal of said driving unit being electrically connected to the output terminal of another driving unit when said second switch is turned on;

wherein said first switch is first turned on to drive an output voltage of said driving unit toward a voltage from corresponding decoder, and during a display data driving period, said second switch is then selectively turned on to drive the output voltage of said driving units toward an average voltage generated from averaging voltages at output terminals of said driving units.

25. A driving device for driving a flat panel display including a plurality of pixels arranged in a matrix format, said driving device comprising:

a first driving units receiving a first voltage and being provided to drive the pixels of the flat panel display, said first driving unit comprising:

a first output buffer;

a first switch electrically connected between an output terminal of said first output buffer and an output terminal of said first driving unit;

a second driving units receiving a second voltage and driving the pixels of the flat panel display, said second driving unit comprising:

a second Output buffer;

a second switch electrically connected between an output terminal of said second output buffer and an output terminal of said second driving unit;

a third switch electrically connected between the output terminal of said first driving unit and the output terminal of said second driving unit; and a detecting circuit for selectively turning on said third switch according to the first voltage and the second voltage.

26. The driving device of claim 25, said third switch is turned on if the first voltage and the second voltage are substantially the same.

27. A driving device for driving a flat panel display including a plurality of pixels arranged in a matrix format, said driving device comprising:

a first driving units receiving a first input driving data and being provided to drive the pixels of the flat panel display according to said first input driving data, said first driving unit comprising:

a first output buffer;

a first switch electrically connected between an output terminal of said first output buffer and an output terminal of said first driving unit;

a second driving units receiving a second input driving data and being provided to drive the pixels of the flat panel display according to said second input driving data, said second driving unit comprising:

a second output buffer;

a second switch electrically connected between an output terminal of said second output buffer and an output terminal of said second driving unit;

a third switch electrically connected between the output terminal of said first driving unit and the output terminal of said second driving unit; and a detecting circuit for selectively turning on said third switch according to the first input driving data and the second input driving data.

28. The driving device of claim 27 wherein said third switch is turned on if the first input driving data and the second input driving data are the same.

29. A method of driving a liquid crystal display (LCD) device, the method comprising:

providing the LCD device with an LCD panel for displaying a plurality of pixels arranged in a matrix format, a voltage selection circuit for outputting a plurality of driving voltage levels according to display data, a plurality of output buffers, a plurality of first switches, and a plurality of second switches, each output buffer electrically coupled between the voltage selection circuit and the LCD panel, each first switch coupled between an output terminal of a corresponding output buffer and a corresponding pixel, and each second switch connected between corresponding two pixels for selectively connecting the corresponding two pixels;

controlling the first switches for connecting the pixels to the corresponding output buffers;

driving pixels located in a row by corresponding output buffers according to corresponding driving voltage levels generated from the voltage selection circuit;

controlling the first switches for disconnecting the pixels from the corresponding output buffers; and during a display data driving period, controlling the second switches for connecting the pixels driven by the same driving voltage level for equalizing voltages applied on the pixels.

30. A method of driving a liquid crystal display (LCD) device, the method comprising:

(a) providing the LCD device with a timing controller, an LCD panel for displaying a plurality of pixels arranged in a matrix format, a voltage selection circuit for outputting a plurality of driving voltage levels according to display data, and a plurality of output buffers, each output buffer electrically coupled between the voltage selection circuit and the LCD panel;

driving pixels located in a row by corresponding output buffers according to corresponding driving voltage levels generated from the voltage selection circuit for driving the corresponding pixels of the LCD;

(c) disconnecting the pixels from the corresponding output buffers;

(d) connecting the pixels driven by the same driving voltage level for equalizing voltages applied on the pixels; and (e) controlling driving sequence of steps (b), (c), and (d) through the timing controller, wherein the timing controller comprises a frequency divider receiving an input data to set a predetermined divisor for dividing the frequency of a clock signal according to the predetermined divisor, a counter for counting the divided clock signal to generate a count value, and a comparator for comparing the count value with a predetermined number to generate a comparison result.

31. A method of driving a liquid crystal display (LCD) device, the method comprising:

(a) providing the LCD device with a timing controller, an LCD panel for displaying a plurality of pixels arranged in a matrix format, a voltage selection circuit for outputting a plurality of driving voltage levels according to display data, and a plurality of output buffers, each output buffer electrically coupled between the voltage selection circuit and the LCD panel;

driving pixels located in a row by corresponding output buffers according to corresponding driving voltage levels generated from the voltage selection circuit for driving the corresponding pixels of the LCD;

(c) disconnecting the pixels from the corresponding output buffers;

(d) connecting the pixels driven by the same driving voltage level for equalizing voltages applied on the pixels; and (e) controlling driving sequence of steps (b), (c), and (d) through the timing controller, wherein the timing controller comprises a frequency divider for dividing the frequency of a clock signal according to the predetermined divisor, a counter for counting the divided clock signal to generate a count value, a comparator for comparing the count value with a predetermined number to generate a comparison result, and a logic controller having a first input port for receiving the comparator result to determine timing to perform steps (b) and (c).

32. A liquid crystal display (LCD) device comprising:

an LCD panel for displaying a plurality of pixels arranged in a matrix format;

a voltage selection circuit for outputting a plurality of driving voltage levels according to display data;

a plurality of output buffers, each output buffer electronically coupled between the voltage selection circuit and the LCD panel for driving the corresponding pixel by corresponding driving voltage level; and a timing controller for controlling driving of the pixels, the timing controller comprising:

a frequency divider for receiving an input data to set a predetermined divisor and for dividing the frequency of a clock signal according to the predetermined divisor;

a counter for counting the divided clock signal to generate a count value; and a comparator for comparing the count value with a predetermined number;

wherein the output buffers are disconnected from the corresponding pixels, and the pixels that are driven by the same driving voltage levels are connected for averaging the voltage applied on the pixels according to the predetermined number.

33. A liquid crystal display (LCD) device comprising:

an LCD panel for displaying a plurality of pixels arranged in a matrix format;

a voltage selection circuit for outputting a plurality of driving voltage levels according to display data;

a plurality of output buffers, each output buffer electronically coupled between the voltage selection circuit and the LCD panel for driving the corresponding pixel by corresponding driving voltage level; and a timing controller for controlling driving of the pixels, the timing controller comprising:

a frequency divider for dividing the frequency of a clock signal according to the predetermined divisor;

a counter for counting the divided clock signal to generate a count value;

a comparator for comparing the count value with a predetermined number; and a logic controller for receiving a comparison result outputted from the comparator to determine whether the pixels driven by the same driving voltage levels are connected for averaging the voltage applied on the pixels or not.

34. A driving device for driving a display panel including a plurality of pixels arranged in a matrix format, the driving device comprising:

a voltage selection circuit for outputting a plurality of driving voltage levels according to display data;

a plurality of output buffers, each output buffer coupled between the voltage selection circuit and the display panel for driving the corresponding pixel by corresponding driving voltage level;

a plurality of first switch circuits each coupled between an output terminal of a corresponding output buffer and a corresponding pixel;

a plurality of second switch circuits each coupled between two pixels for selectively connecting the two pixels; and a control circuit, selectively turning on the second switch circuit to connect the two pixels according to corresponding display data or the corresponding driving voltage level.

35. A method of driving a liquid crystal display (LCD) device, the method comprising:

(a-0) providing the LCD device with:

an LCD panel for displaying a plurality of pixels arranged in a matrix format;

a voltage selection circuit for outputting a plurality of driving voltage levels according to display data;

a timing controller comprising a frequency divider for dividing a frequency of a clock according to a predetermined divisor, a counter for counting the divided clock signal to generate a count value, a comparator for comparing the count value with a predetermined number to generate a comparison result, and a logic controller; and a plurality of output buffers, each output butter electrically coupled between the voltage selection circuit and the LCD panel;

driving pixels located in a row by corresponding output buffers according to corresponding driving voltage levels generated from the voltage selection circuit for driving the corresponding pixels of the LCD;

(b) disconnecting the pixels from the corresponding output buffers;

(c) connecting the pixels driven by the same driving voltage level for equalizing voltages applied on the pixels, and turning off the operating voltages inputted into the corresponding output buffers; and (d) utilizing the timing controller for controlling the driving sequence of steps (a), (b), and (c), wherein the logic controller comprises a first input port for receiving the comparator result to determine timing to perform steps (b) and (c).

36. A liquid crystal display (LCD) device comprising:

an LCD panel for displaying a plurality of pixels arranged in a matrix format;

a voltage selection circuit for outputting a plurality of driving voltage levels according to display data;

a plurality of output buffers, each output buffer electronically coupled between the voltage selection circuit and the LCD panel for driving the corresponding pixel by corresponding driving voltage level; and a timing controller for controlling driving of the pixels, the timing controller comprising:

a frequency divider for dividing the frequency of a clock signal according to a predetermined divisor;

a counter for counting the divided clock signal to generate a count value;

a comparator for comparing the count value with a predetermined number; and a logic controller comprising a first input port for receiving a comparison result outputted from the comparator to determine whether the count value is equal to the predetermined number or not;

wherein the output buffers are disconnected from the corresponding pixels, operating voltages inputted into the output buffers are turned off, and the pixels that are driven by the same driving voltage levels are connected for averaging the voltage applied on the pixels according to the predetermined number.

* * * * *